US006865995B2

(12) United States Patent
Chuo

(10) Patent No.: US 6,865,995 B2
(45) Date of Patent: Mar. 15, 2005

(54) STRUCTURE OF A MOTOR DRIVEN DRIVING MECHANISM OF A SEWING MACHINE

(76) Inventor: Jui-Jung Chuo, No. 39, Alley 21, Lane 193, Jungjeng N. Rd., Sanchung City, Taipei Hsien (TW)

( * ) Notice: Subject to any disclaimer, the term of this patent is extended or adjusted under 35 U.S.C. 154(b) by 7 days.

(21) Appl. No.: 10/283,065

(22) Filed: Oct. 30, 2002

(65) Prior Publication Data

US 2004/0083936 A1 May 6, 2004

(51) Int. Cl.[7] ..... D05B 69/12
(52) U.S. Cl. ..... 112/220
(58) Field of Search ..... 112/258, 259, 112/217.3, 220, 284; 384/510

(56) References Cited

U.S. PATENT DOCUMENTS 1,524,026 A * 1/1925 Diehl ..... 112/220
1,936,412 A * 11/1933 Stephenson ..... 112/220
2,223,315 A * 11/1940 Diehl et al. ..... 112/220
3,597,672 A * 8/1971 Seesselberg et al. ..... 318/259
3,821,937 A * 7/1974 Seesselberg ..... 112/280
4,503,792 A * 3/1985 Cook ..... 112/220
4,926,769 A * 5/1990 Upmeier ..... 112/470.06
5,125,354 A * 6/1992 Hayashi et al. ..... 112/259
5,711,237 A * 1/1998 Ripplinger ..... 112/220
5,905,318 A * 5/1999 Faulhaber et al. ..... 310/58
6,105,522 A * 8/2000 Kato ..... 112/220
6,164,224 A * 12/2000 Tachikawa et al. ..... 112/68

FOREIGN PATENT DOCUMENTS

GB 2 135 345 A 8/1984

* cited by examiner

*Primary Examiner*—Ismael Izaguirre
(74) *Attorney, Agent, or Firm*—Birch, Stewart, Kolasch, & Birch, LLP.

(57) ABSTRACT

A structure of a motor driven driving mechanism of a sewing machine comprises a motor mounted on one side of the sewing machine and a driving mechanism disposed inside the frame of the sewing machine driven by the motor. A rotor shaft extends out of the cover, the rotor shaft comprises a connecting portion for connecting with the driving mechanism, and at least one resilient element is disposed on two sides of the connecting portion for connecting the connecting portion with the driving mechanism. Since the rotor shaft rotatably drives the driving mechanism, therefore frictional or ramming effects among the assembly parts can be eliminated or at least substantially reduced. Thus noise during operation and the damage to the mechanical parts can be effectively reduced.

14 Claims, 9 Drawing Sheets

STRUCTURE OF A MOTOR DRIVEN DRIVING MECHANISM OF A SEWING MACHINE

FIELD OF THE INVENTION

The present invention relates to a sewing machine, and more particularly relates to a structure of a motor driven driving mechanism of a sewing machine comprising a motor mounted on a outer side surface of the frame of the sewing machine.

BACKGROUND OF THE INVENTION

Referring to FIG. 8, a conventional sewing machine 1 is mounted on a desktop 7, comprises a motor 8 for driving the sewing machine 1 for sewing clothes, which motor 8 is installed beneath the desktop 7. The motor 8 comprises a rotor shaft 81 having a belt rotor 82. An endless belt 83 is mounted around the rotor 82 and a belt roller 84, this arrangement is disposed on the outside of the sewing machine 1. As the motor 8 is electrically energized, the rotor shaft 81 rotates the rotor 82, which in turn will transmit the power through the endless belt 83 to rotatably drive the belt roller 84. The belt roller 84 rotatably drives the sewing shaft for driving the sewing needle of the sewing machine 1 to start the process of stitching the clothes. However, in order to install the belt 83, the belt 83 needs to pass through the desktop 7, and thus it is difficult to assemble and/or disassemble the belt 83.

According to another conventional design, a motor 9 is installed behind the sewing machine 1 (as shown in FIG. 9). An endless belt 93 is mounted around a rotor 91 of the motor 9 and a belt roller 92 to rotatably drive the sewing shaft of the sewing machine 1. However, in both of the above-mentioned prior art arrangements, it is essential that tightness of the belt should be well adjusted for proper power transmission. In other words, if the tightness of the belts 83 and 93 is not well adjusted, then the power transmission from motor 8 and 9 through the belts 83 and 93 to drive sewing shaft of the sewing machine 1 is not sufficient. This will cause break downs or damage to the sewing mechanism of the sewing machine 1. Further, after a long-time of operation of the belts 83 and 93, the belts 83 and 93 losses some elasticity, and thus tightness of the belts are not sufficient to effectively drive the sewing shaft of the sewing machine 1.

Furthermore, in prior art U. K. Patent GB 2135345 entitled motor-driven sewing machine, discloses that the motor is installed inside the frame together with other assembly parts such as sewing shaft and its rotation mechanism for operating the sewing machine and controlling the motor through an external controlling device. The other conventional sewing machine APW297 was manufactured by JUKI, which has a motor installed at an upper part inside the frame of the sewing machine. Still some have taken the center of gravity into consideration with a view of stable operation of the sewing machine, and accordingly proposed to install the motor at a rear upper part inside the frame of the sewing machine. These latter two designs of sew machine could incur extra labor cost due to difficulty in assembling the assembly of parts, and also it is very difficult to remove the motor from inside the frame of the sewing machine for replacement or repair when damage to the motor occurs. This design causes problems during maintenance and increases the cost due to long maintenance interruptions.

SUMMARY OF THE INVENTION

Accordingly, it is an object of the present invention to provide a structure of a motor driven driving mechanism of a sewing machine comprising a more simplified assembly arrangement capable of eliminating or at least for substantially reducing the problems encountered in the prior art as described above.

It is another object of the present invention to provide a structure of a motor driven driving mechanism of a sewing machine comprising a motor mounted on an outer side surface of the frame of the sewing machine, therefore this arrangement allows easy maintenance of the motor. Thus the maintenance cost can be effective reduced.

It is another object of the present invention to provide a structure of a motor driven driving mechanism of a sewing machine so that the driving mechanism can be driven without or at least with substantially reduced friction among the assembly parts during the operation, thus this would substantially reduces damage to assembly parts and effectively promotes the life-time of the assembly parts.

It is another object of the present invention to provide with a more simplified assembly parts for making a driving mechanism so that the maintenance assembly and/or disassembly of assembly parts can be implemented easily and thus the labor cost can be effectively reduced. This would also reduce the frequency of damage of the assembly parts.

In order to achieve the above objects and other advantages of the present invention, a structure of a motor driven driving mechanism of a sewing machine is provided. The motor driven driving mechanism of a sewing machine comprises a motor mounted on an outer side surface of a frame of the sewing machine and a driving mechanism disposed inside the frame of the sewing machine is rotatably connected to the motor. A rotor shaft extends out of the motor, the rotor shaft comprises a connecting portion for connecting with the driving mechanism, and at least one resilient element is disposed on two sides of the connecting portion for connecting the connecting portion with the driving mechanism.

According to one aspect of the present invention, the driving mechanism comprises one or more than one sectional axles. The driving mechanism is positioned in the frame and at a bottom part of the sewing machine. The rotor shaft rotatably connects with a first driving axle. The first driving axle passes through a thick portion of the frame of the sewing machine, and is supported by the thick portion to aid smooth operation of the first driving axle. A connecting end is disposed at a distal end of the first motivating axle which connects with connecting portion of the rotor shaft.

According to another aspect of the present invention, a connecting element is connected to a distal end of the first motivating axle for connecting the first driving axle with a second driving axle. A plurality of apertures are disposed on the connecting element for fixing screw elements for securing the first and second driving axles. When the first driving axle is rotatably driven by the rotor shaft, the second driving axle rotates along with the first driving axle. This would further rotatably drives the sewing shaft which in turn will drive the needle of the sewing machine for initiating the sewing mechanism or stitching mechanism.

According to another aspect of the present invention, the first driving axle of the driving mechanism which passes through the thick portion of the frame of the sewing machine extending in the space on the two opposite sides of the thick portion, is supported by the thick portion of the frame to aid smooth operation. Further, a bearing is disposed within the thick portion of the frame to come in contact around the first driving axle for the smooth rotation of the first driving axle. A belt roller is mounted around an end portion of the first driving axle. An endless belt on the belt roller and a roller of the sewing mechanism are disposed inside the frame of the sewing machine in a manner that when the first driving axle is rotatably driven, the power is transmitted through the belt roller and the endless belt to the roller of the sewing mechanism for rotatably driving the sewing mechanism of sewing machine so as to drive the sewing needle reciprocatingly to initiate sewing.

According to another aspect of the present invention, the portion of the first driving axle that is positioned in the other side of the thick portion comprises the connecting element for connecting the first driving axle with the second driving axle, thus the second driving axle rotates along with the rotation of the first driving axle.

According to another aspect of the present invention, the first and second driving axles together with the belt roller and the endless belt is connected to a connecting element which is disposed within the wall of the frame of the sewing machine. The screw elements are passed through the threaded apertures formed on a surface of the protruded portion for securely fixing the motor onto the wall of the frame of the sewing machine in a manner that the motor is positioned outside the frame of the sewing machine. During fixing the motor, the rotor shaft of the motor is extended into the assembling portion, and the connecting portion rotatably couples with a frontal portion of the rotor shaft, which in turn rotatably connects with the distal connecting end of the first motivating axle. Thus in this arrangement the motor rotatably drives the rotor shaft and the first driving axle.

According to another aspect of the present invention, the rotor shaft is extended directly up to the belt roller and connected with the belt roller and the first driving axle, thus the process of manufacturing the assembling parts can be minimised in order to achieve a more simplified assembly process.

According to another aspect of the present invention, the rotor shaft is extended up to the connecting element and connected with the connecting element and the second driving axle, thus the process of manufacturing the assembling parts can be minimised to achieve a more simplified assembly process.

According to another aspect of the present invention, the driving mechanism of the present invention can comprise a single driving axle assembled inside the frame of the sewing machine without the need of connecting element, thus a more simplified assembly process can be achieved. Further, by fixing the motor on an outside surface of the frame of the sewing machine makes the motor directly rotatably drive the driving mechanism and thus increases the efficiency of driving and this will also provide a smoother operation of the driving mechanism. This would further reduce the frequency of damage to the assembly parts, and also make the assembling job more simplified and easy.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

For a more complete understanding of the present invention, reference will now be made to the following detailed description of preferred embodiments taken in conjunction with the accompanying drawings, which are given by way of illustration only, and thus are not limitative of the present invention, and in which.

DESCRIPTION OF THE PREFERRED EMBODIMENTS

Figure 1:
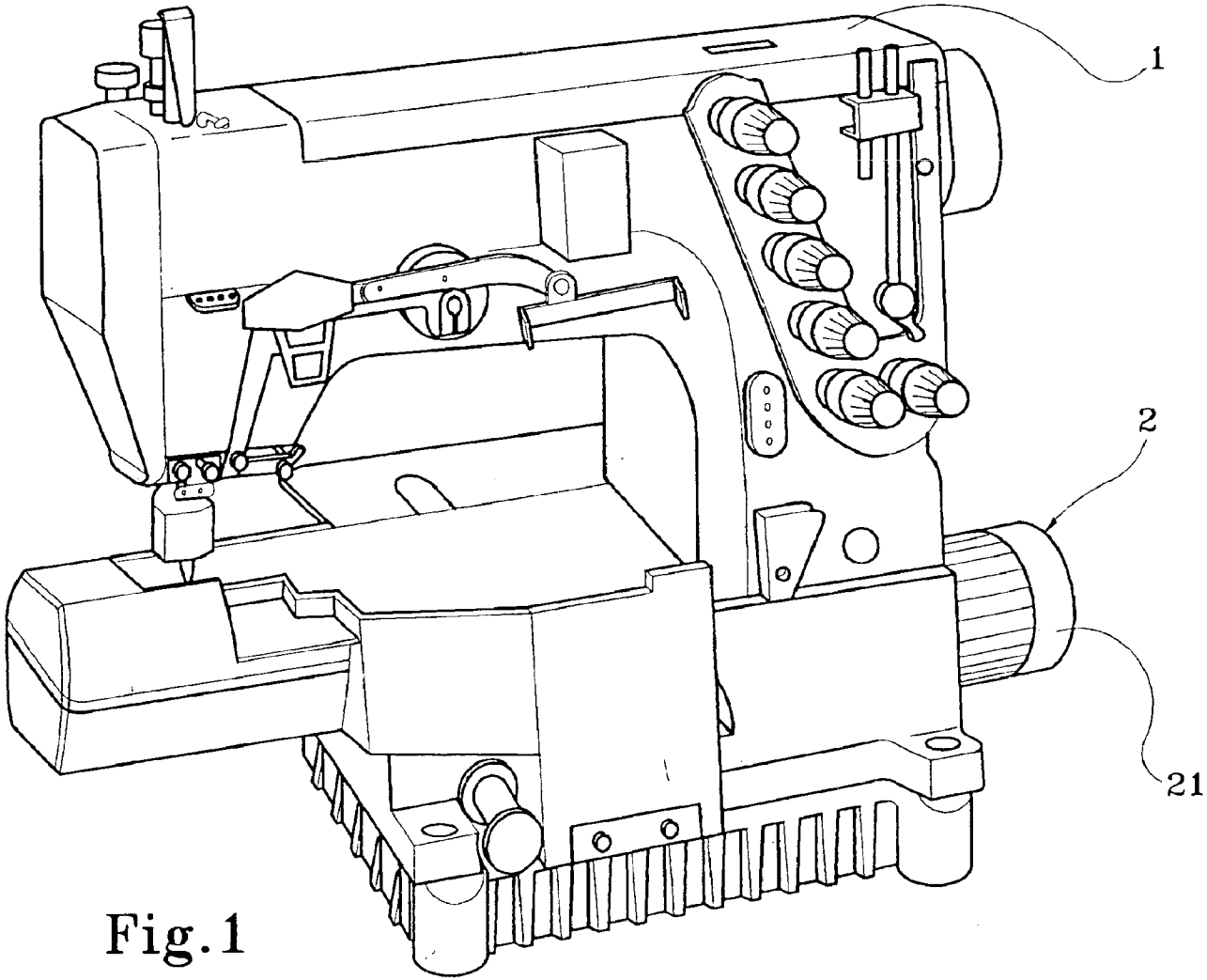
FIG. 1 is an embodiment a structure of a motor driven driving mechanism of a sewing machine of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
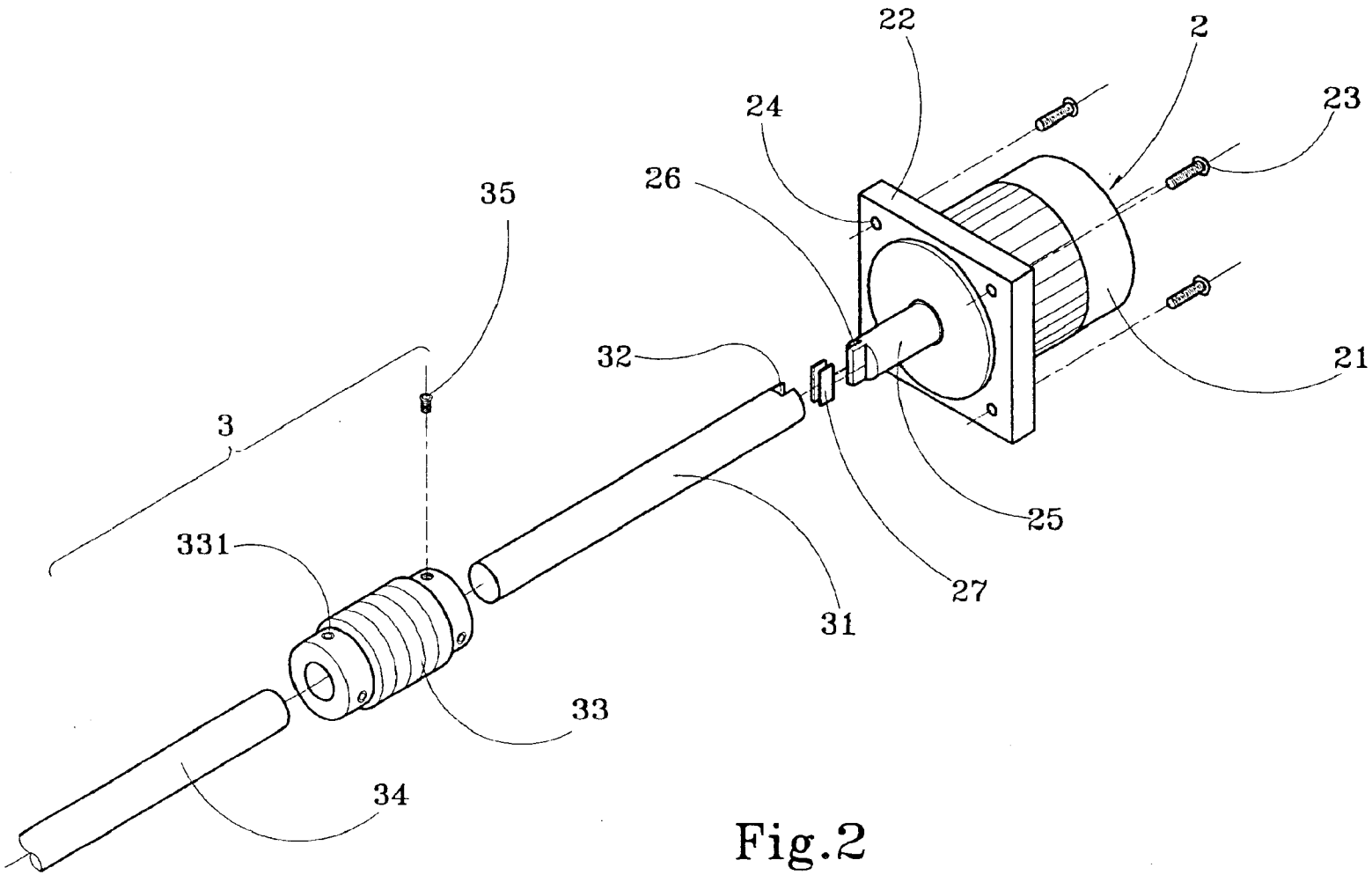
FIG. 2 is exploded view of the motor and the driving mechanism of the sewing machine according to the present invention.

Referring to FIGS. 1 and 2, a structure of a motor driven driving mechanism of a sewing machine 1 of the present invention comprises a motor 2 mounted on an outer side surface of a frame of the sewing machine 1 and a driving mechanism 3 disposed inside the frame of the sewing machine 1 is rotatably connected to the motor 2. The motor 2 and the driving mechanism 3 in this arrangement would substantially improve the driving efficiency and substantially reduce the frequency of damage to assembly parts of the sewing machine 1.

The motor 2 is either an alternative current driven motor or direct current driven motor. The motor 2 comprises a cover 21 having a protruded portion 22 at a frontal side. The protruded portion 22 has an aperture 24 for fitting a fixing element 23 to secure the motor 2 onto the side of the sewing machine 1. A rotor shaft 25 extends out from the motor 2, the rotor shaft 25 comprises a connecting portion 26 for connecting with the driving mechanism 3, and at least one resilient element 27 is disposed on two sides of the connecting portion 26 for connecting the connecting portion 26 with the driving mechanism 3. Since the rotor shaft 25 rotatably drives the driving mechanism 3, therefore frictional or ramming effects in between the mechanical parts can be eliminated or at least substantially reduced. Thus noise during operation and the damage to the mechanical parts can be effectively reduced.

The driving mechanism 3 comprises one or more than one sectional axles. The driving mechanism 3 is positioned at a bottom part of the sewing machine 1. An axle (not shown) axially connects with a first driving axle 31. The first driving axle 31 passes through a thick portion 13 of the frame of the sewing machine 1, and is supported by the thick portion 13 to aid smooth operation of the first driving axle 31. A connecting end 32 is disposed at a distal end of the first motivating axle 31 which connects with connecting portion 26 of the rotor shaft 25. As the motor 2 is electrically energized, the rotor shaft 25 rotatably drives the first driving axle 31. A connecting element 33 is connected to a distal end of the first motivating axle 31 (positioned on the other side of the thick portion 13) for connecting the first driving axle 31 with a second driving axle 34. A plurality of apertures 331 is disposed on the connecting element 33 for fixing screw elements 35 for securing the first and second driving axles 31 and 34. When the first driving axle 31 is rotatably driven by rotor shaft 25, the second driving axle 34 rotates along with the first driving axle 31. This would further rotatably drives the sewing shaft which in turn will drive the needle of the sewing machine for initiating the sewing mechanism or stitching mechanism (not shown).

Figure 3:
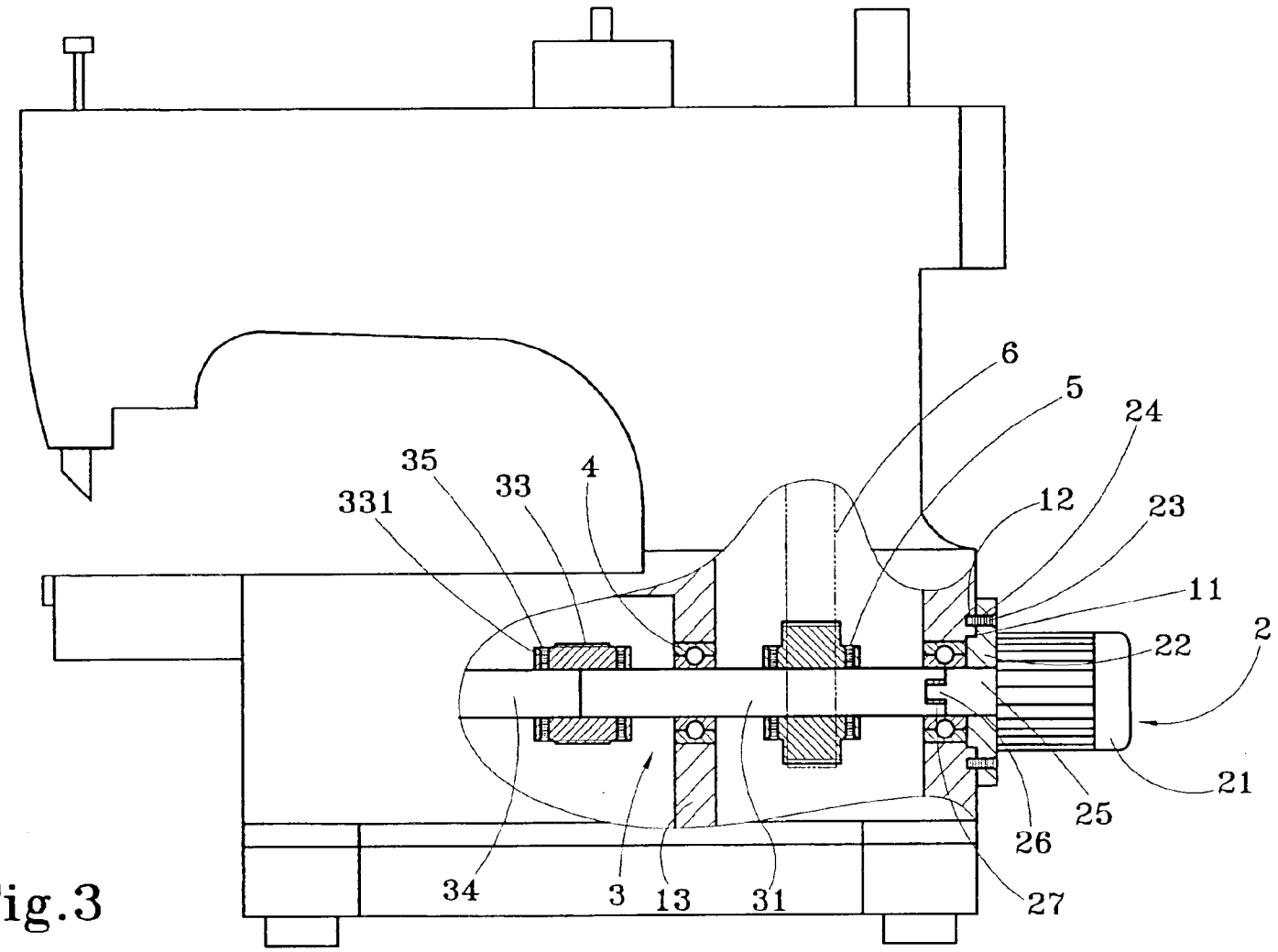
FIG. 3 is an embodiment of the assembly of the motor, the driving mechanism of the sewing machine of the present invention.
Figure 4:
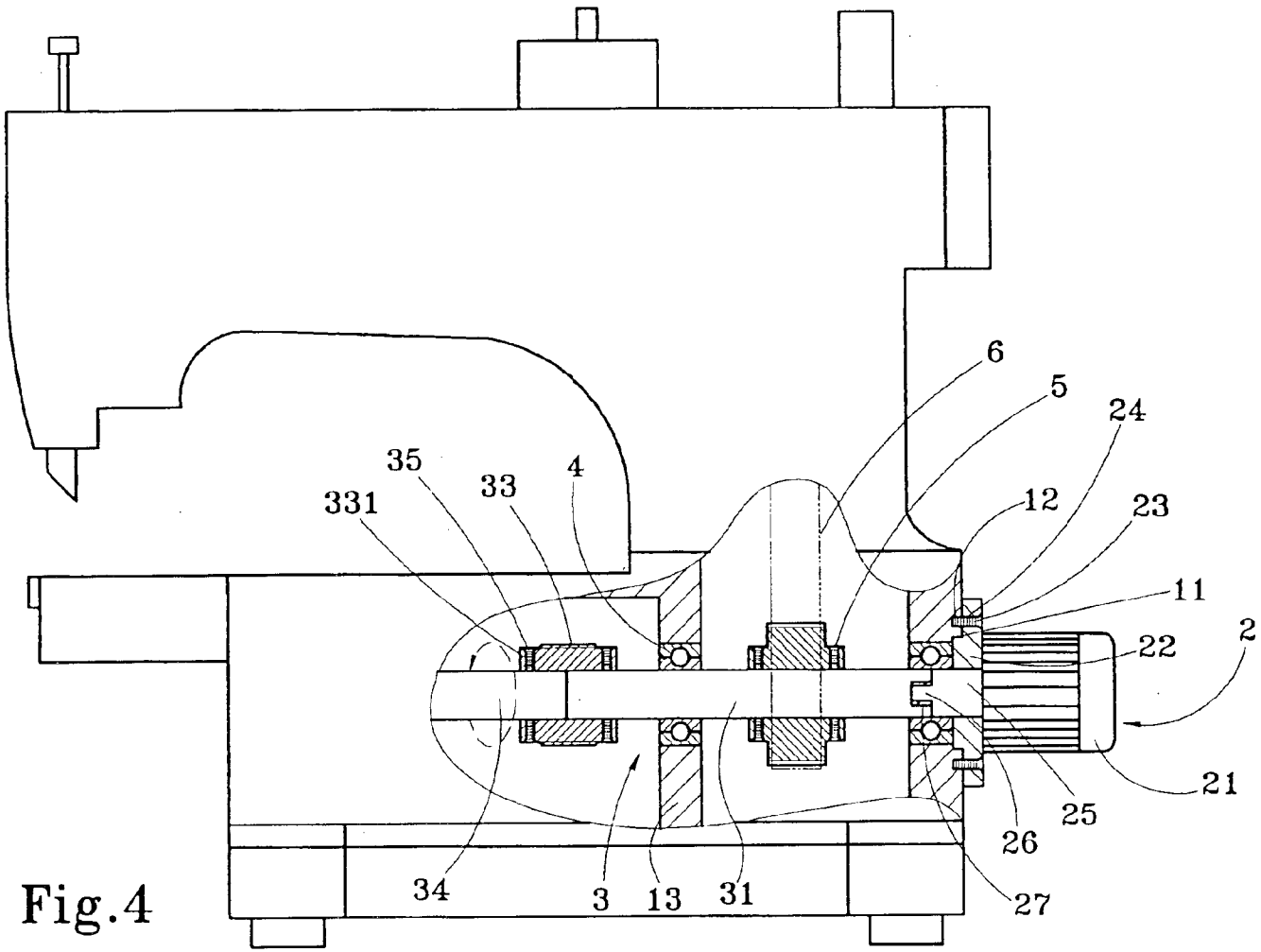
FIG. 4 is a view of operating embodiment of the present invention.

Referring to FIGS. 3 and 4, the first driving axle 31 of the driving mechanism 3 which is passes through the thick portion 13 of the frame of the sewing machine 1 extending in the space on the two opposite sides of the thick portion 13, is supported by thick portion of the frame to aid smooth operation. Further, a bearing 4 is disposed within thick portion 13 of the frame to come in contact around the first driving axle 31 for the smooth rotation of the first driving axle 31. A belt roller 5 is mounted around an end portion of the first driving axle 31. An endless belt 6 is mounted on the belt roller 5 and a roller of the sewing mechanism (not shown) inside the frame of the sewing machine 1 in a manner that when the first driving axle 31 is rotatably driven, the power is transmitted through the belt roller 5 and the endless belt 6 to the roller of the sewing mechanism (not shown) for rotatably driving the sewing mechanism of sewing machine 1 so as to drive the sewing needle reciprocatingly to initiate the sewing process.

The portion of the first driving axle 31 that is positioned in the other side of the thick portion 13 comprises the connecting element 33 for connecting the first driving axle 31 with the second driving axle 34, thus the second driving axle 34 rotates along with the rotation of the first motivating axle 31.

The assembling of the assembly parts of the sewing machine 1 of the present invention will be described as follows. The first and second driving axles 31, 34 together with the belt roller 5 and the endless belt 6 is connected to a connecting element 11 which is disposed within the wall 12 of the frame of the sewing machine 1. The screw elements 23 are passed through the threaded apertures 24 formed on a surface of the protruded portion 22 for securely fixing the motor 2 onto the wall 12 of the frame of the sewing machine 1 in a manner that the motor 2 is positioned outside the frame of the sewing machine 1. During fixing of the motor 2, the rotor shaft 25 of the motor 2 is extended into the assembling portion 11, and the connecting portion 26 rotatably couples with a frontal portion of the rotor shaft 25, which in turn rotatably connects with the distal connecting end 32 of the first motivating axle 31. Thus in this arrangement the motor 2 rotatably drives the rotor shaft 25 and the first driving axle 31.

Figure 5:
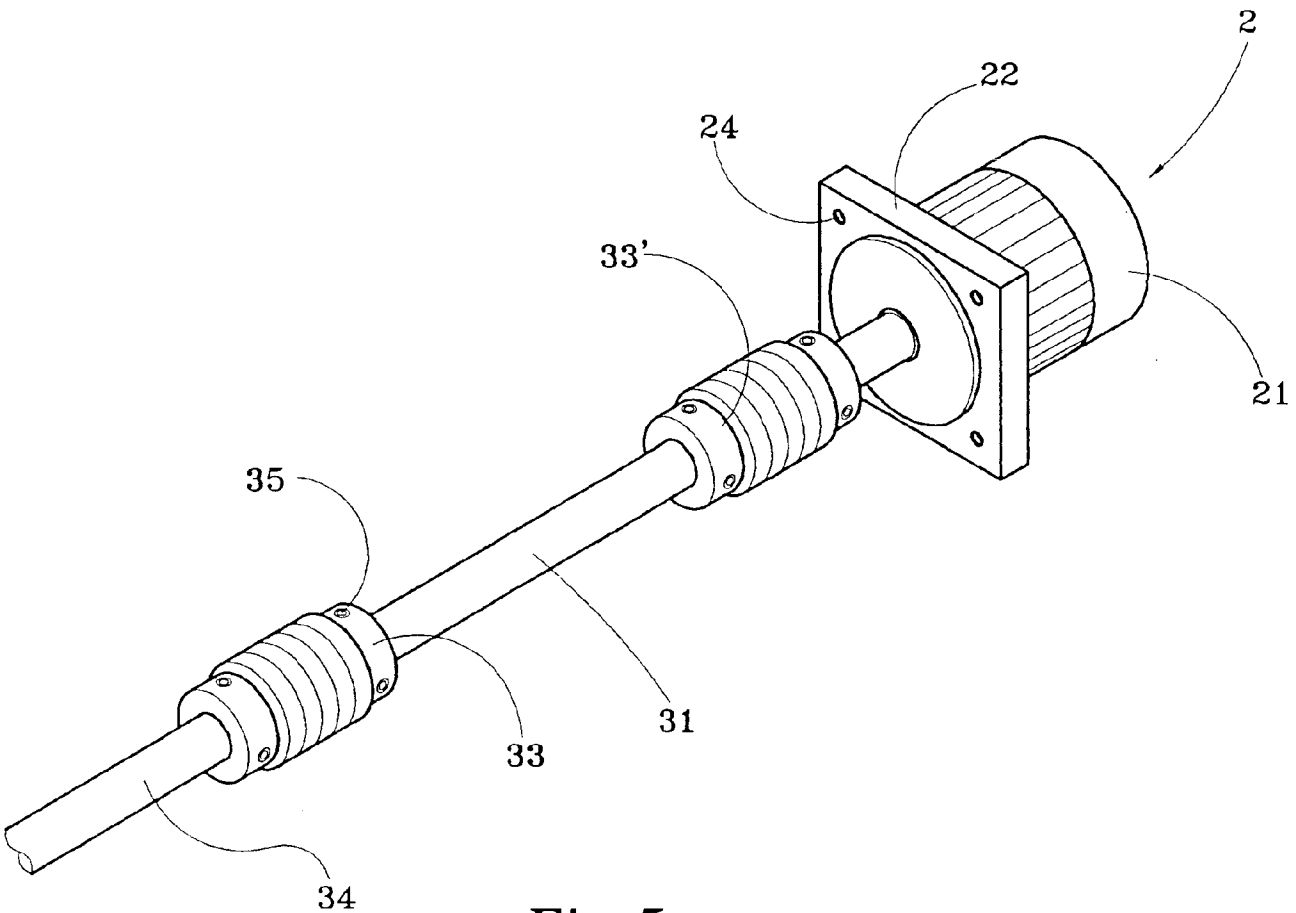
FIG. 5 is another embodiment of a structure of a motor driven driving mechanism of a sewing machine of the present invention.

Referring to FIG. 5, the structure of the embodiment is similar to the one described in FIG. 2, except for a connecting element 33' which is installed on the rotor shaft 25 of the motor 2. The connecting element 33' will aid the first driving axle 31 to rotate stably during the operation of the motor 2.

Figure 6:
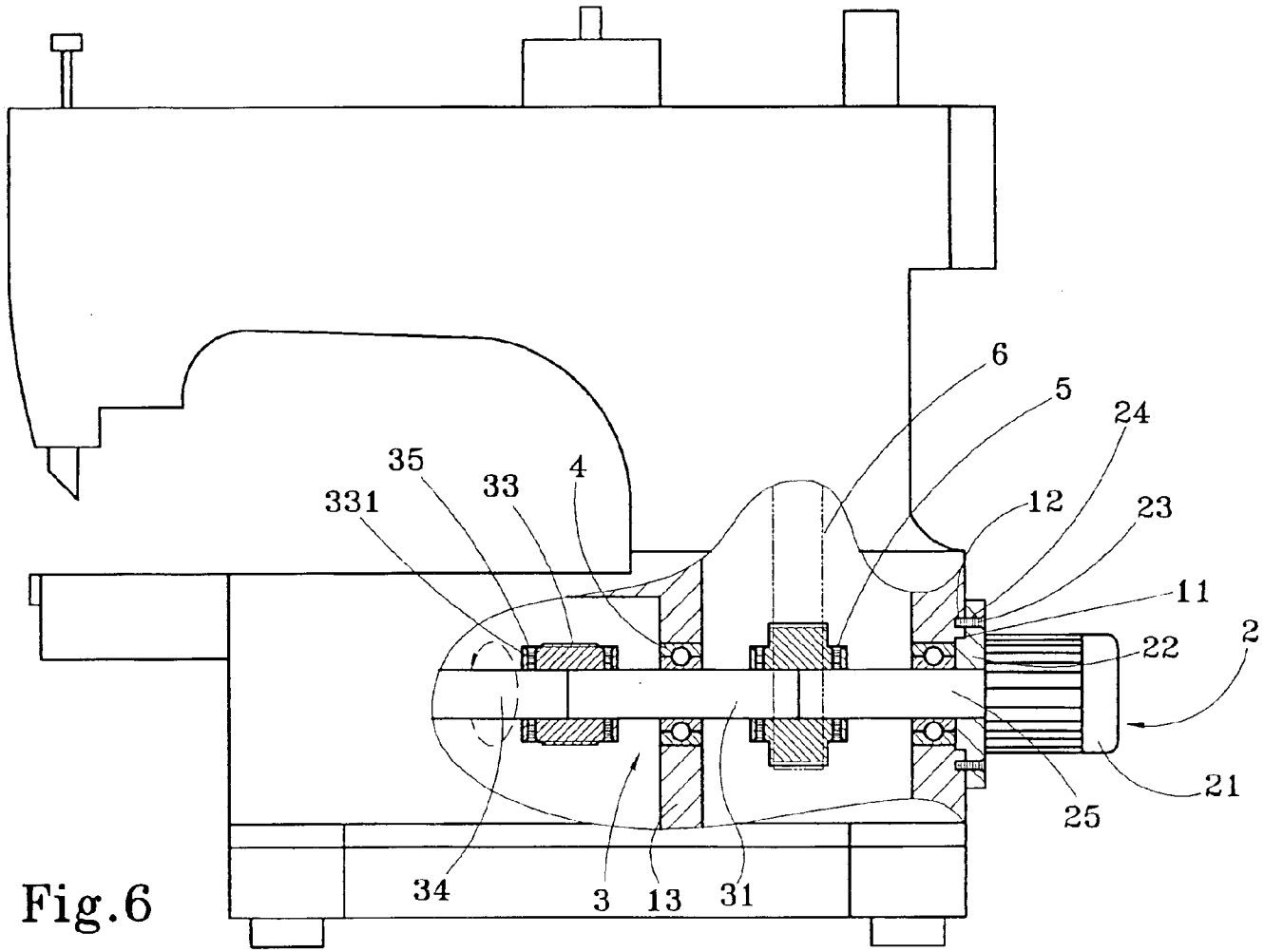
FIG. 6 is another embodiment of a structure of a motor driven driving mechanism of a sewing machine of the present invention.

Referring to FIG. 6, the rotor shaft 25 is extended directly up to the belt roller 5 and connected with the belt roller 5 and the first driving axle 31 (or the second motivating axle 34), thus the process of manufacturing the assembling parts 26, 32 and the resilient element 27 can be omitted in order to achieve a more simplified assembly process.

Figure 7:
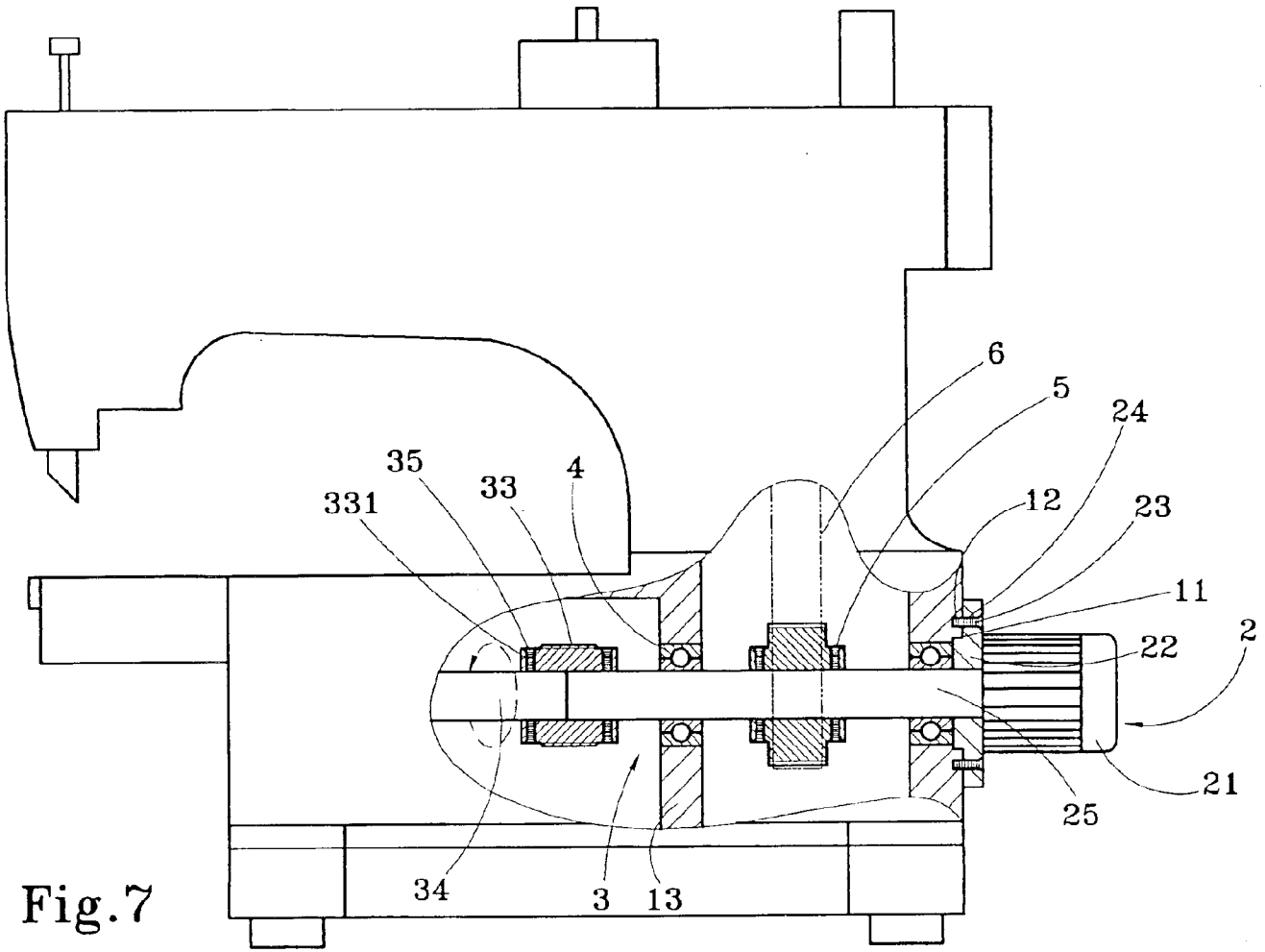
FIG. 7 is another embodiment of a structure of a motor driven driving mechanism of a sewing machine of the present invention.
Figure 8:
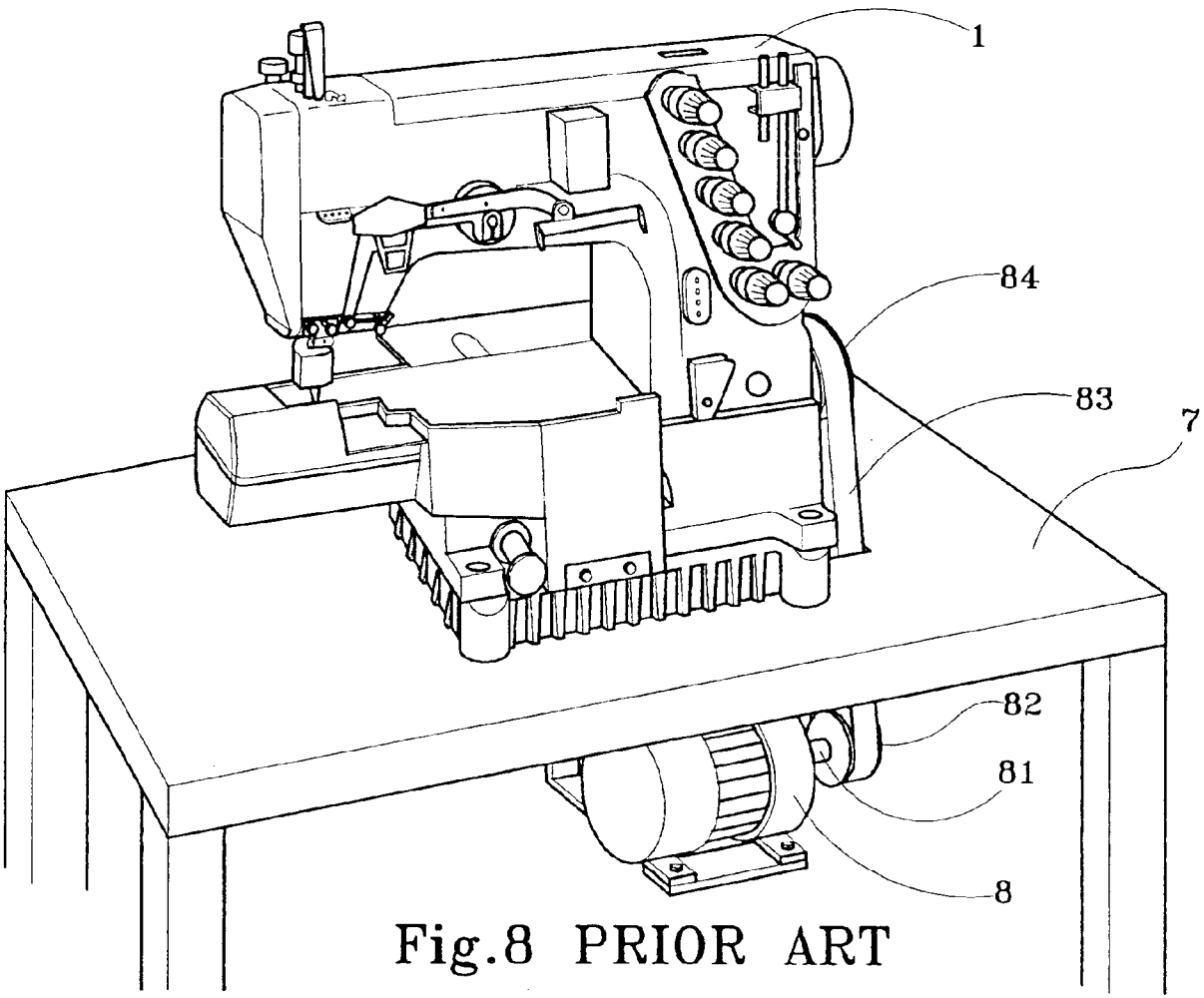
Fig.8 PRIOR ART
FIG. 8 is an embodiment of a conventional sewing machine.
Figure 9:
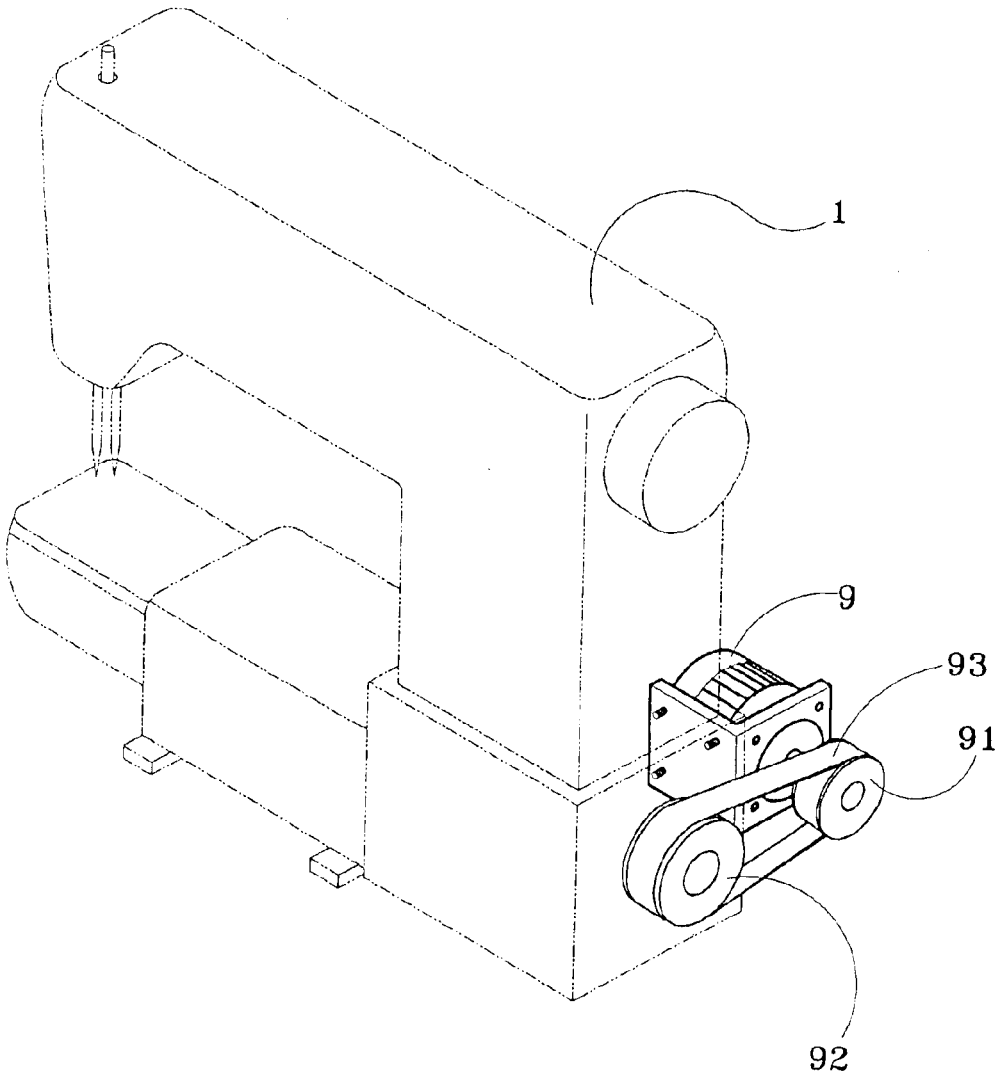
Fig.9 PRIOR ART
FIG. 9 is an embodiment of another conventional sewing machine.

Referring to FIG. 7, the rotor shaft 25 is extended up to the connecting element 33 and connected with the connecting element 33 and the second driving axle 34 (or the first motivating axle 31), thus the process of manufacturing the assembling parts 26, 32 the resilient element 27 and the first motivating axle 31 can be omitted to achieve a more simplified assembly process.

Further more, the driving mechanism 3 of the present invention can comprise a single driving axle assembled inside the frame of the sewing machine 1 without the need of connecting element 33 or 33', thus a more simplified assembly process can be achieved. Further, by fixing the motor 2 on a outside surface of the sewing machine 1 makes the motor 2 directly rotatably drive the driving mechanism 3 and thus increases the efficiency of driving and this will also provide a smoother operation of the driving mechanism 3. This would further reduce the frequency of damage the assembly parts, and also make the assembly job more simplified and easy.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

What is claimed is:

1. A structure of a motor driven driving mechanism of a sewing machine, comprising:

a motor mounted on an outer, bottom side surface of a frame of a sewing machine for rotatably driving a driving mechanism positioned inside the frame of said sewing machine, wherein the driving mechanism is connected to a belt roller positioned internally within the sewing machine, a belt extends upwardly from the belt roller and is driven by the belt roller, wherein the motor comprises a rotor shaft extending into the sewing machine, the rotor shaft being connected to a first axle and being linearly aligned therewith, the belt roller being mounted on the first axle, and the driving mechanism further comprising a second axle connected to the first axle and being located within the sewing machine, the second axle being linearly aligned with the first axle and the rotor.

2. The structure of the motor driven driving mechanism according to claim 1, wherein said motor is an alternate current motor or a direct current motor.

3. The structure of the motor driven driving mechanism according to claim 1, wherein said motor comprises:

a cover having a protruded portion at a frontal side, wherein said protruded portion comprises a plurality of threaded apertures for fixing screw elements;

a rotor shaft extending from the motor, comprising a connecting portion having at least one resilient element on two sides, wherein said rotor shaft is axially and rotatably connected to a belt roller and a first driving axle, or said rotor shaft is axially connected to a connecting element, and said connecting element is connected to a second driving axle.

4. The structure of the motor driven driving mechanism according to claim 1, wherein said driving mechanism comprises a single driving axle, or a first and a second driving axles with a plurality of connecting sections, wherein said driving axle passes through a thick portion of the frame of the sewing machine.

5. The structure of the motor driven driving mechanism according to claim 3, wherein said first driving axle comprises an assembling portion at a distal end, wherein a connecting element is used for rotatably connecting with said second driving axle, wherein said connecting element comprises a plurality of apertures for fixing a plurality of fixing elements for securing said connecting element onto said first and second driving axles, wherein a belt roller is mounted around a distal end portion of said first driving axle, and wherein an endless belt is positioned on said belt roller.

6. The structure of the motor driven driving mechanism according to claim 1, wherein said motor has a rotor shaft which has a connecting element.

7. The structure of the motor driven driving mechanism according to claim 1, wherein the driving mechanism is positioned below a needle of the sewing machine.

8. A structure of a motor driven driving mechanism of a sewing machine, comprising:

a motor mounted on an outer, bottom side surface of a frame of a sewing machine for rotatably driving a driving mechanism positioned inside the frame of said sewing machine, wherein the driving mechanism is connected to a belt roller positioned internally within the sewing machine, a belt extends upwardly from the belt roller and is driven by the belt roller, wherein the motor comprises a rotor shaft extending into the sewing machine, the rotor shaft being connected to a first axle and being linearly aligned therewith, the belt roller being mounted on the first axle, and wherein the first and second axels are positioned below a needle of the sewing machine.

9. The structure of the motor driven driving mechanism according to claim 8, wherein said motor is an alternate current motor or a direct current motor.

10. The structure of the motor driven driving mechanism according to claim 8, wherein said motor comprises:

a cover having a protruded portion at a frontal side, wherein said protruded portion comprises a plurality of threaded apertures for fixing screw elements;

a rotor shaft extending from the motor, comprising a connecting portion having at least one resilient element on two sides, wherein said rotor shaft is axially and rotatably connected to a belt roller and a first driving axle, or said rotor shaft is axially connected to a connecting element, and said connecting element is connected to a second driving axle.

11. The structure of the motor driven driving mechanism according to claim 8, wherein said driving mechanism comprises a single driving axle, or a first and a second driving axles with a plurality of connecting sections, wherein said driving axle passes through a thick portion of the frame of the sewing machine.

12. The structure of the motor driven driving mechanism according to claim 10, wherein said first driving axle comprises an assembling portion at a distal end, wherein a connecting element is used for rotatably connecting with said second driving axle, wherein said connecting element comprises a plurality of apertures for fixing a plurality of fixing elements for securing said connecting element onto said first and second driving axles, wherein a belt roller is mounted around a distal end portion of said first driving axle, and wherein an endless belt is positioned on said belt roller.

13. The structure of the motor driven driving mechanism according to claim 8, wherein said motor has a rotor shaft which has a connecting element.

14. The structure of the motor driven driving mechanism according to claim 8, wherein the driving mechanism is positioned below a needle of the sewing machine.

* * * * *